US005438947A

United States Patent [19]

Tam

[11] Patent Number: 5,438,947

[45] Date of Patent: Aug. 8, 1995

[54] INTERNAL PASSAGE UNDERWATER VEHICLE

[76] Inventor: Isaac Y. Tam, 470 Americano Way, Fairfield, Calif. 94533

[21] Appl. No.: 277,220

[22] Filed: Jul. 19, 1994

[51] Int. Cl.[6] ..... B63G 8/08

[52] U.S. Cl. ..... 114/312; 114/337

[58] Field of Search ..... 114/312, 337, 338, 20.2; 440/38, 46, 68; 60/221

[56] References Cited

U.S. PATENT DOCUMENTS

| | | | |
|---|---|---|---|
| 1,759,511 | 5/1930 | Kort | 440/38 |
| 1,991,512 | 2/1935 | Miller | 440/38 |
| 3,134,353 | 5/1964 | Pedersen et al. | 60/221 X |
| 3,464,357 | 9/1969 | Duport et al. | 440/38 X |

FOREIGN PATENT DOCUMENTS

| | | | |
|---|---|---|---|
| 0766993 | 7/1934 | France | 440/68 |
| 3149618 | 7/1983 | Germany | 440/68 |
| 0279990 | 11/1988 | Japan | 440/68 |
| 0124982 | 7/1918 | United Kingdom | 440/68 |

*Primary Examiner*—Sherman Basinger

[57] ABSTRACT

An underwater vehicle with unconventional configuration is disclosed, wherein the lateral boundary of the vehicle is parallel to the straight moving direction of the vehicle. There is an internal passage tunnel disposed inside the vehicle, connecting the front end and the rear end of the vehicle. The front and rear openings of the tunnel extend to the entire cross section of the vehicle. Looking from the outside, the vehicle is like an elongated tube with very thin walls. In operation, the water in the front of the vehicle is transported to the rear of the vehicle exclusively through the internal passage tunnel. Very little disturbances will be imparted to the surrounding water. This vehicle is highly efficient even at high speeds, hence is extremely suitable for high speed and long range operations.

12 Claims, 3 Drawing Sheets

INTERNAL PASSAGE UNDERWATER VEHICLE

BACKGROUND-FIELD OF INVENTION

This invention is related to underwater vehicles, more specifically to those underwater vehicles having unusual configurations for fast and efficient underwater maneuvering.

BACKGROUND-DISCUSSION OF PRIOR ART

Underwater vehicles are without exception driven by a process that transports the body of water in the front of the vehicle to the rear of the vehicle.

Conventional underwater vehicles accomplish this process by pushing aside the water in the front of the vehicle, and this water will go around the outside of the vehicle to fill the void left behind by the vehicle. At low speed, this process can be quite efficient: most of the water pushed aside by the vehicle goes to the rear of the vehicle, with very little disturbances to the surrounding water. At higher speeds however, the water pushed aside by the vehicle does not go directly to the rear of the vehicle, but goes farther to the side, and the surrounding water rushes in to fill the void left behind by the vehicle. This causes disturbances to the surrounding water. The higher the speed, the more the disturbances, no matter how aerodynamic the shape is. Worse yet, this relationship is disproportional: a small increase in speed can cause a big increase in disturbances. Disturbance to surrounding water is energy lost. As a result, conventional underwater vehicles have very low efficiencies at high speeds. In other words, conventional underwater vehicles consume disproportionally more energy at high speeds. This imparts great limitations on the speed of the vehicle.

Furthermore, without exception, the mode of operation of conventional underwater vehicles is to have a propulsion system to propel water to a very high speed relative to the surrounding water. This inevitably disturbs the surrounding water to a great extent, further decreasing the efficiency of the vehicle.

OBJECTS AND ADVANTAGES

It is an object of this invention to provide an underwater vehicle that is substantially more efficient than conventional underwater vehicles.

It is another object of this invention to provide an underwater vehicle that is capable of high speed and long range travel.

It is still another object of this invention to provide an underwater vehicle which, in operation, causes minimal disturbances to the surrounding water.

SUMMARY OF THE INVENTION

The process of moving an underwater vehicle is to transport the water in front of the vehicle to the rear of the vehicle. This invention employs a very unconventional way to accomplish this process by transporting water through the inside of the vehicle. The outside, or the lateral boundary of the vehicle is substantially parallel to the direction of movement of the vehicle. The front end and rear end of the vehicle are totally open. The hull of the vehicle bulges gradually inwardly, but leaving a tunnel connecting the front opening and the rear opening. A propeller is placed inside the tunnel at the narrowest point, to pump water from the front end of the vehicle to the rear end of the vehicle.

Viewing from the outside, the vehicle looks like a tube with very thin walls. In operation, this vehicle acts also like a tube with very thin walls, that cuts through water longitudinally with very little effort. The reason for this has two folds.

Firstly, since the outside or the lateral boundary of the vehicle is parallel to the direction of movement of the vehicle, it does not disturb the surrounding water when the vehicle is moving longitudinally.

Secondly, in the inside of the vehicle, when the vehicle is moving at a steady speed, being pumped by the propeller, water enters the vehicle through the front opening. As the hull of the vehicle bulges gradually, the passage tunnel narrows down gradually, and the water picks up speed gradually. The water reaches the highest speed at the narrowest point of the tunnel where the propeller is placed. After passing this point, the sequence is reversed. When exiting the vehicle through the rear opening, the speed of the water is almost down to zero. Hence, the water is transported from the front of the vehicle to the rear of the vehicle through the inside of the vehicle with very little disturbances to the surrounding water.

Little disturbances to surrounding water mean little energy lost. This vehicle is so efficient, it can maintain at high speed without significant increase in energy consumption. With a same amount of energy supply, it has a much greater range of travel than conventional underwater vehicles.

DETAILED DESCRIPTION OF THE INVENTION

Figure 1:
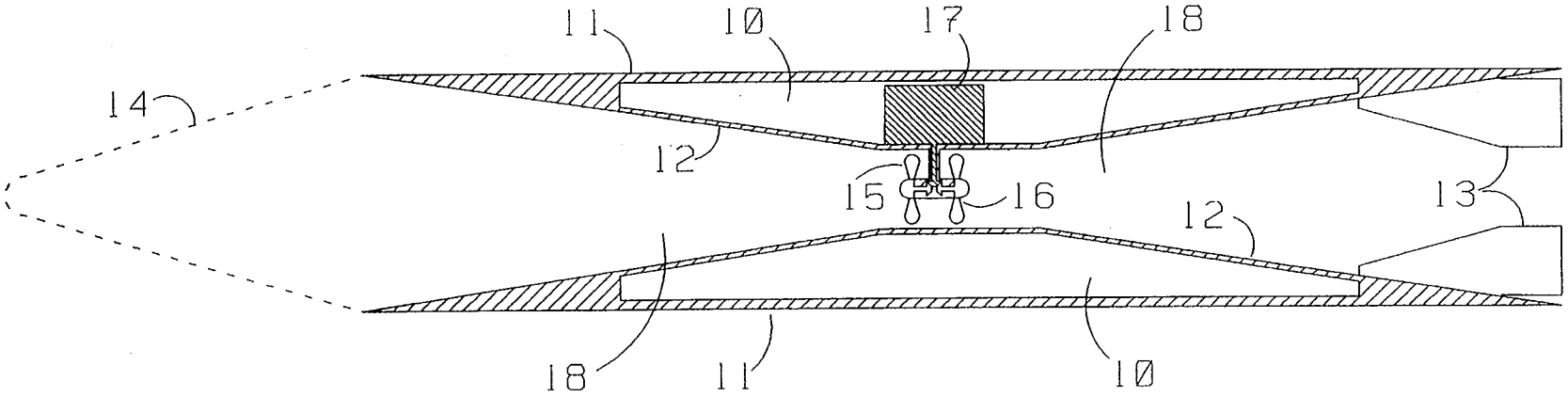
FIG. 1 is a longitudinal section of the first preferred embodiment, taken from line 1—1 of FIG. 2.
Figure 2:
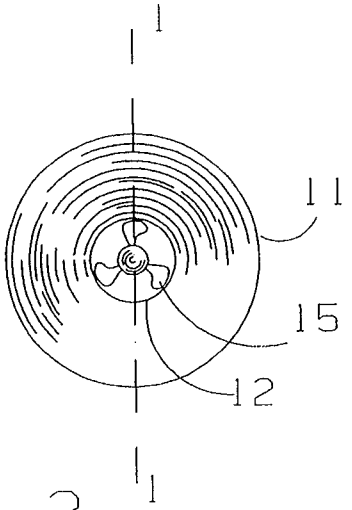
FIG. 2 is a front view of the first preferred embodiment.

FIG. 1 and FIG. 2 depict the first preferred embodiment, wherein FIG. 1 is a longitudinal section taken from line 1—1 of FIG. 2, and FIG. 2 is a front view of the vehicle body.

In FIG. 1 and FIG. 2, 10 is the hull of the vehicle, 11 is an outer wall, 12 is an inner wall, 13 is a rudder, 14 is a front filter, 15 is a front propeller, 16 is a rear propeller, 17 is a motor that drives the propellers 15 and 16, 18 is an internal passage tunnel.

The whole body of the vehicle is elongated. Outer wall 11, which forms the lateral boundary of the vehicle, is parallel to the longitudinal direction or the straight moving direction of the vehicle. Inner wall 12 is concaved inwardly to form an internal passage tunnel 18 for channelling water from the front of the vehicle to the rear of the vehicle. Propellers 15 and 16 are placed at the narrowest area of internal passage tunnel 18, and are driven by motor 17 to rotate in opposite directions from one another. Front filter 14 is mounted in the front to prevent large objects from entering internal passage tunnel 18, since large objects can clog the tunnel and hinder the operations of the propellers 15 and 16. Front filter 14 has a wedge shape, so that large objects that can not go through the filter will not get caught but slide to the side. Rudder 13 is either a fixed fin or an adjustable fin that mounted on the vehicle to control the going direction of the vehicle.

As clearly indicated in FIG. 1, the front and rear openings of internal passage tunnel 18 extend to the entire cross section of the vehicle. The water in the front of the vehicle will be moved to the rear of the vehicle exclusively through internal passage tunnel 18. When the vehicle is moving at a steady speed, the speed of the water entering the vehicle through the front opening is zero. Pumping by the propellers 15 and 16, and as tunnel 18 narrows down gradually, the water picks up speed gradually. The water reaches highest speed at the narrowest point of tunnel 18. After this point, the speed of the water decreases gradually as tunnel 18 widens gradually. When exiting tunnel 18 through the rear opening, the speed of the water will get back down to zero. Hence, when the vehicle passes by at a steady speed, it leaves very little disturbances to the surrounding water. In other words, it wastes very little energy when going at a steady speed.

Figure 3:
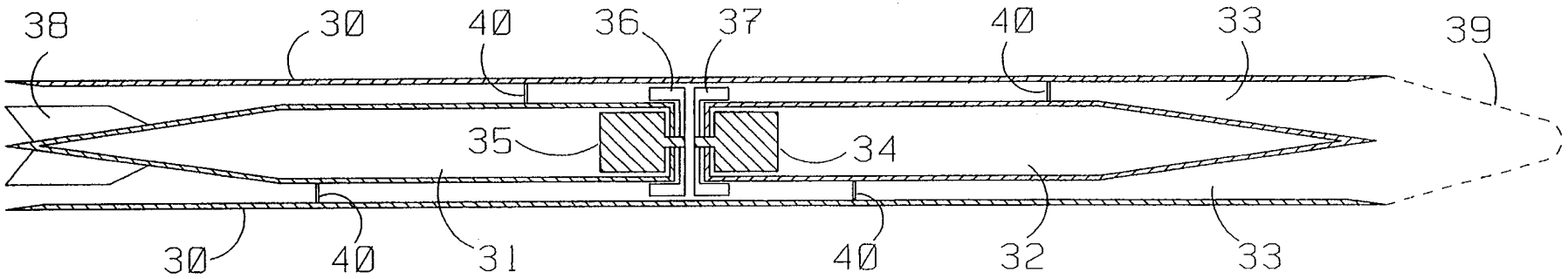
FIG. 3 is a longitudinal section of the second preferred embodiment, taken from line 3—3 of FIG. 4.
Figure 4:
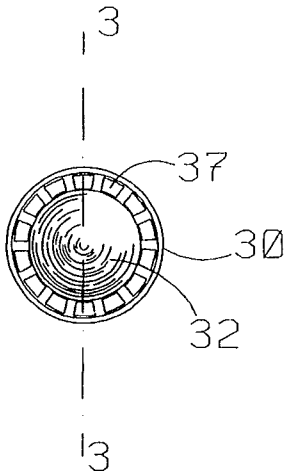
FIG. 4 is a front view of the second preferred embodiment.

FIG. 3 and FIG. 4 depict the second preferred embodiment of the invention, wherein FIG. 3 is a longitudinal section taken from line 3—3 of FIG. 4, and FIG. 4 is a front view of the vehicle body.

In FIG. 3 and FIG. 4, 30 is an outer tube means, 31 is a rear main hull, 32 is a front main hull, 33 is an internal passage tunnel, 34 is a front motor, 35 is a rear motor, 36 is a rear propeller, 37 is a front propeller, 38 is a rudder, 39 is a front filter, 40 is a connecting post that fixedly connects outer tube means 30 to the main hulls 31 and 32.

The whole body of the vehicle is elongated. Outer tube means 30, which forms the lateral boundary of the vehicle, is parallel to the longitudinal or the straight moving direction of the vehicle. Main hulls 31 and 32 are enveloped by outer tube means 30. The space between outer tube means 30 and main hulls 31 and 32 becomes an internal passage tunnel 33. Internal passage tunnel 33, as clearly indicated in FIG. 3, has front and rear openings extending to the entire cross section of outer tube means 30. Main hulls 31 and 32 bulge up gradually inwardly, so that internal passage tunnel 33 narrows down gradually inwardly. Propellers 36 and 37 are placed at the narrowest area of internal passage tunnel 33. Front motor 34 drives front propeller 37. Rear motor 35 drives rear propeller 36. Propellers 36 and 37 are driven to rotate in opposite directions. Rudder 38 is either a fixed fin, or an adjustable fin to control the moving direction of the vehicle. Front filter 39 is mounted to the edge of the front opening of outer tube means 30, to prevent large objects from entering internal passage tunnel 33. Front filter 39 has a wedge shape so that large objects that can not go through the filter will not be caught, but slide to the side. Connecting post 40, that fixedly connects outer tube means 30 to main hulls 31 and 32, has a very small diameter so that it does not impart any significant hindrance to the flow of water that goes through internal passage tunnel 33.

The water in the front of the vehicle will be pumped by propellers 36 and 37 to the rear of the vehicle, exclusively through internal passage tunnel 33, so that at steady speed, the vehicle leaves very little disturbances to the surrounding water. The vehicle can cruise at high speed very efficiently.

Figure 5:
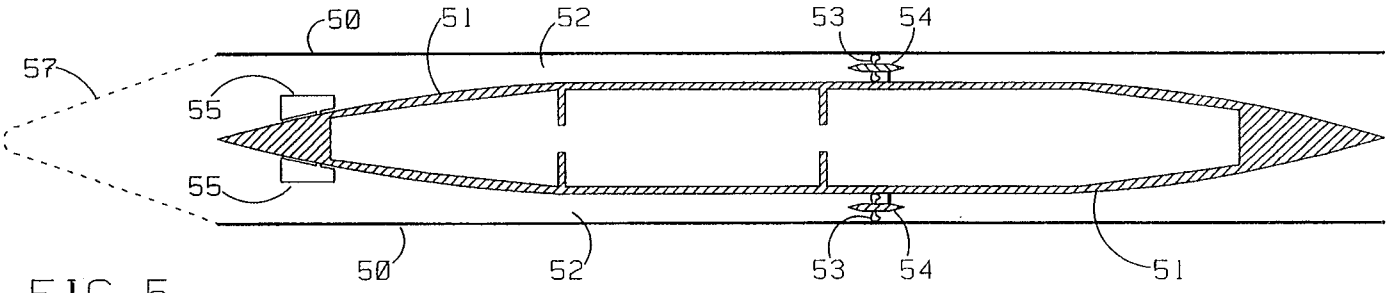
FIG. 5 is a longitudinal section of the third preferred embodiment, taken from line 5—5 of FIG. 7.
Figure 6:
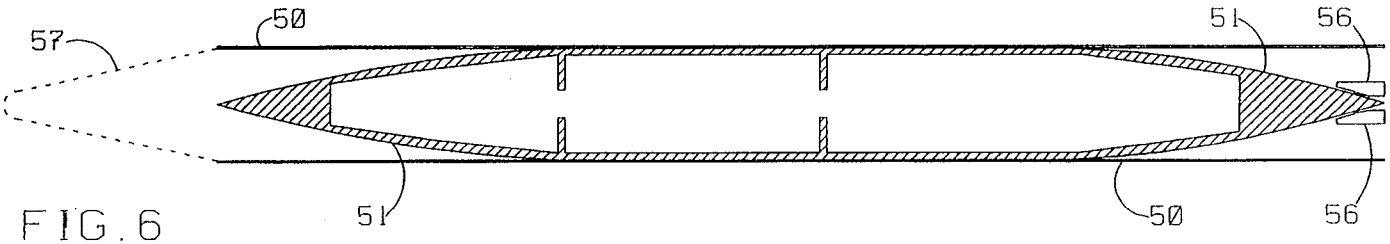
FIG. 6 is a longitudinal section of the third preferred embodiment, taken from line 6—6 of FIG. 7.
Figure 7:
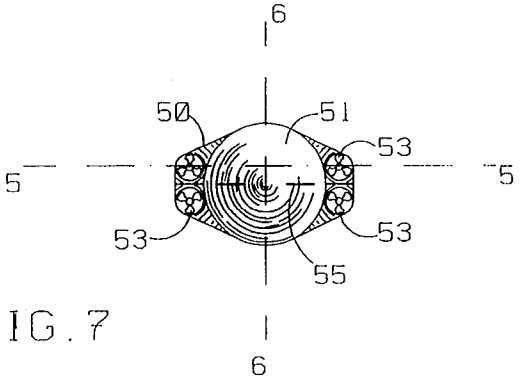
FIG. 7 is a front view of the third preferred embodiment.

FIG. 5, FIG. 6, and FIG. 7 depict the third preferred embodiment of the invention, wherein FIG. 5 is a longitudinal section taken from line 5—5 of FIG. 7, FIG. 6 is a longitudinal section taken from line 6—6 of FIG. 7, and FIG. 7 is a front view of the vehicle body.

In FIG. 5, FIG. 6, and FIG. 7, 50 is an outer tube means, 51 is a main hull, 52 is an internal passage tunnel, 53 is a propeller, 54 is a motor to drive propeller 53, 55 is a front rudder, 56 is a rear rudder, 57 is a front filter.

The whole body of the vehicle is elongated. Outer tube means 50, which forms the lateral boundary of the vehicle, is parallel to the longitudinal or the straight moving direction of the vehicle. Main hull 51 is enveloped by outer tube means 50. Part of the top and part of the bottom of main hull 51 merge with outer tube means 50. The space between outer tube means 50 and main hull 51 becomes an internal passage tunnel 52. Internal passage tunnel 52, as clearly indicated in FIG. 5 and FIG. 6, has front and rear openings extending to the entire cross section of outer tube means 50. Main hull 51 bulges gradually inwardly, so that internal passage tunnel 52 narrows down gradually inwardly. A propeller 53 is placed at the narrowest area of tunnel 52. Both front and rear rudders 55 and 56 are adjustable to control the moving direction of the vehicle. Front filter 57 is to prevent large objects from getting into internal passage tunnel 52. Front filter 57 has a wedge shape so that large objects that can not pass filter 57 will not get caught, but slide to the side.

As clearly indicated in FIG. 7, this embodiment has four propellers 53, to eliminate the necessity of a single but large propeller. This embodiment is suitable for large submarines wherein a single large propeller is not feasible.

The water in the front of the vehicle will be pumped to the rear of the vehicle by propeller 53, exclusively through internal passage tunnel 52, so that at steady speed, the vehicle leaves very little disturbances to the surrounding water.

While my above description contains many specificities, these should not be construed as limitations on the scope of the invention, but rather as an exemplification of a few preferred embodiments thereof. Many other variations are possible. Accordingly, the scope of the invention should be determined not by the embodiments illustrated, but by the appended claims and their legal equivalents.

What is claimed is:

1. An internal passage underwater vehicle comprising: p1 (a) an elongated body means normally longitudinally movable, having the entirety of the lateral boundary of said body means extending lengthwise to substantially cover the entire length of said vehicle, the entirety of said lateral boundary substantially parallel to the straight moving direction of said vehicle;

(b) internal passage means for channeling water from front of said vehicle to rear of said vehicle, said internal passage means disposed within said lateral boundary;

(c) pump means for pumping water from front of said vehicle to rear of said vehicle through said internal passage means.

2. An internal passage underwater vehicle as defined in claim 1, further comprising a front filter means for preventing large objects from entering said internal passage means.

3. An internal passage underwater vehicle as defined in claim 1, wherein the front and rear openings of said internal passage means extend to the entire cross section of said vehicle.

4. An internal passage underwater vehicle as defined in claim 1, wherein the front and rear openings of said internal passage means extend to the entire cross section of said vehicle, further comprising a front filter means for preventing large objects from entering said internal passage means.

5. An underwater vehicle comprising:

(a) an elongated enclosure means normally longitudinally movable, forming the boundaries of said vehicle, said elongated enclosure means having the entirety of outer walls extending lengthwise to substantially cover the entire length of said vehicle, the entirety of said outer walls substantially parallel to the straight moving direction of said vehicle, said elongated enclosure means having inner walls concaved to form an internal passage means for channeling water from front of said vehicle to rear of said vehicle;

(b) pump means for pumping water from front of said vehicle to rear of said vehicle through said internal passage means.

6. An internal passage underwater vehicle as defined in claim 5, further comprising a front filter means for preventing large objects from entering said internal passage means.

7. An internal passage underwater vehicle as defined in claim 5, wherein the front and rear openings of said internal passage means extend to the entire cross section of said vehicle.

8. An internal passage underwater vehicle as defined in claim 5, wherein the front and rear openings of said internal passage means extend to the entire cross section of said vehicle, further comprising a front filter means for preventing large objects from entering said internal passage means.

9. An internal passage underwater vehicle comprising:

(a) an elongated tube means, forming the lateral boundary of said vehicle, the entirety of said lateral boundary extending lengthwise to substantially cover the entire length of said vehicle, the entirety of said lateral boundary substantially parallel to the straight moving direction of said vehicle;

(b) main hull means mounted within said tube means;

(c) internal passage means disposed between said tube means and said main hull means for channeling water from front of said vehicle to rear of said vehicle;

(d) pump means for pumping water from front of said vehicle to rear of said vehicle through said internal passage means.

10. An internal passage underwater vehicle as defined in claim 9, further comprising a front filter means for preventing large objects from entering said internal passage means.

11. An internal passage underwater vehicle as defined in claim 9, wherein the front and rear openings of said internal passage means extend to the entire cross section of said vehicle.

12. An internal passage underwater vehicle as defined in claim 9, wherein the front and rear openings of said internal passage means extend to the entire cross section of said vehicle, further comprising a front filter means for preventing large objects from entering said internal passage means.

* * * * *